United States Patent [19]

Masters

[11] Patent Number: 4,503,799

[45] Date of Patent: Mar. 12, 1985

[54] COMBINATION FLOTATION STORAGE AND SEATING STRUCTURES FOR BOATS

[76] Inventor: William E. Masters, 313 Dogwood La., Easley, S.C. 29640

[21] Appl. No.: 372,666

[22] Filed: Apr. 28, 1982

[51] Int. Cl.[3] ..... B63B 35/72

[52] U.S. Cl. ..... 114/363; 114/347; 297/195

[58] Field of Search ..... 272/72; 114/347, 363, 114/360, 270; 297/195, 429, 431, 432

[56] References Cited

U.S. PATENT DOCUMENTS

| | | | |
|---|---|---|---|
| 523,151 | 7/1894 | Perkins | 114/363 |
| 1,035,046 | 8/1912 | Pitre | 114/360 |
| 1,041,679 | 10/1912 | Sargent | 114/347 |
| 1,172,974 | 2/1916 | Frayser | 114/347 |
| 2,330,341 | 9/1943 | DuPont et al. | 297/195 |
| 3,703,877 | 11/1972 | Ueda | 114/270 |
| 3,958,289 | 5/1976 | Carlson | 114/347 |
| 4,106,143 | 8/1978 | Lucas | 114/363 |
| 4,125,285 | 11/1978 | Hanagan | 297/195 |
| 4,229,850 | 10/1980 | Arcouette | 114/347 |
| 4,357,894 | 11/1982 | Kirk | 114/347 |

FOREIGN PATENT DOCUMENTS

| | | | |
|---|---|---|---|
| 948491 | 6/1974 | Canada | 114/347 |
| 659228 | 10/1951 | United Kingdom | 114/188 |

*Primary Examiner*—Trygve M. Blix
*Assistant Examiner*—Thomas J. Brahan
*Attorney, Agent, or Firm*—Schwartz, Jeffery, Schwaab, Mack, Blumenthal & Koch

[57] ABSTRACT

The structures include hollow water-tight bodies. One body is adapted to attach to a boat between the bow and stern of the boat. A saddle area is formed in the center of the body and knee braces are formed on the body forward of the saddle area to permit a person to brace against. A seat is formed to the rear of the saddle area to allow a person to sit erect. The body has hatch covers which allow access to the interior thereof for storage or the like. Thus the body acts as seat, storage area and flotation device. A second hollow body is provided in a shape conforming to the shape of the bow or stern of the boat. This body can be attached to the bow or stern of the boat and acts as a storage area, additional flotation device and/or end cap.

22 Claims, 10 Drawing Figures

COMBINATION FLOTATION STORAGE AND SEATING STRUCTURES FOR BOATS

BACKGROUND OF THE INVENTION

1. Field of the Invention

This invention relates to auxiliary equipment for small boats, and more particularly to such equipment adapted to provide seating, storage and flotation for boats, such as canoes.

2. Discussion of Related Art

For many years, the sport of canoeing, for example, has been a popular pastime because canoes are versatile and may be used for pleasure boating in many environments. For those enthusiasts who are properly trained, canoes make an ideal and exciting mode of transportation along treacherous rivers and streams. Often, canoe enthusiasts go on extended trips which require that supplies, such as camping gear and a quantity of food, be taken along. Thus, it is desirable to keep these supplies dry and in good condition during the entire trip and ensure that they will not be lost in the event that the canoe tips over.

Many canoes are manufactured with little, if any, flotation built in; therefore, it is desirable to supply or increase the flotation so that the canoeist can safely cling to the canoe in the event of a mishap. In order to increase the flotation, some canoeists have taken ordinary plastic jars and affixed them to the ends of the canoe by pouring foam around them. Also, commonly available expanded foam flotation devices can be purchased and attached to the canoe. However, these devices share the defect that they take up valuable space within the canoe, which space could otherwise be used for storage of gear and supplies.

When canoeing in relatively rough water, the control that the canoeist has over the craft is determined in large part by his or her weight distribution within the craft in combination with the control obtained by proper manipulation of the canoe paddle. In order to be fully in control of the canoe, the canoeist should be able to brace himself or herself within the boat at all times. Accordingly, it would be desirable to have some device by which the canoeist can be braced within the canoe and yet free to move in order to distribute his or her weight.

SUMMARY OF THE INVENTION

One object of the present invention is to provide a group of structures which can be inserted into a boat, which structures provide additional flotation for the boat.

A further object of the present invention is to provide a group of structures which can be inserted into a boat and which serve as storage space for supplies and gear. This storage space also acts as the flotation for the boat; thus, the flotation does not use up valuable space within the boat.

A further object of the present invention is to provide structures which can be inserted in a boat, which structures, in addition to providing flotation and storage, aid one in bracing himself or herself within the boat thereby providing maximum control.

A still further object of the present invention is to provide structures which can be inserted in a boat, which structures are capable of increasing the structrual integrity of the boat thereby decreasing the risk of fractures or other damage to the boat when contacting rocks or the like.

In accordance with the above and other objects, the present invention includes a first water-tight hollow body which is adapted to be connected to a boat. In the case of a canoe, which has a plurality of cross-braces, the body may have a longitudinal dimension at least as great as the distance between two of the cross-braces, and a bottom which is adapted to engage the bottom of the canoe hull. The hollow body includes a device for gaining access to the interior space of the body whereby gear and other supplies can be stored therein. A first attachment device is formed on one end of the hollow body for engaging a first cross-brace of the canoe. A second attachment device is formed on the opposite end of the hollow body for engaging a second cross-brace of the canoe. A saddle area is formed on the hollow body between the attachment devices and constructed to permit a person to straddle the body. Knee braces are formed on the body forward of the saddle area to permit a person to brace against when straddling the hollow body at the saddle area.

In accordance with other objects of the present invention, a seat portion is formed on the hollow body to the rear of the saddle area thereby permitting the canoeist to sit in an erect, upright position, if desired.

Additionally, a channel is formed in the bottom of the hollow body longitudinally of the body. A bracing tube may be received in the channel and forced against the bottom of the canoe hull to add structural integrity thereto. If desired, a second similar hollow body may be attached to the canoe between an additional two cross-braces of the canoe. The bracing tube would then extend from the channel in one hollow body to the channel in the second hollow body. Also, notches are distributed along the body from one end to the other. A strap may be connected around the body through one of the forward notches and used as an additional brace for the knees of a canoeist. A toe block may be inserted in one of the rear notches for the canoeist to brace his or her toes against.

The attachment devices include platforms formed on the top of the body. The forward platform is disposed directly above the knee braces to provide additional support thereto. The rear platform is provided to the rear of the seating area. Foam pads or the like may be inserted between the associated cross-brace and platform to take up space and cushion the body. Additional foam pads may be attached between the bottom of the body and the bottom of the canoe hull. Bolts are passed through the associated cross-braces and platforms to secure the body to the canoe.

A further hollow body is provided in the form of the bow or stern portion of the canoe. This body has a relatively flat, planar top surface which is generally triangular in plan. One edge of the top surface has a raised lip so that any equipment, such as ropes or the like, which is placed on the top surface will not slide off. The body is provided with an end wall having a hatch cover to allow access to the interior of the body. This body can be attached by the use of clips connected to the gunnels of the canoe. Nuts are molded into the body for connection to the clips. This body can also be provided with a raised outwardly protruding lip which overlaps the gunnels of the boat so that the body acts as a protective end cap.

BRIEF DESCRIPTION OF THE DRAWINGS

The above and other objects and advantages of the present invention will become more readily apparent in connection with the detailed description given below, reference being had to the accompanying drawings wherein like reference numerals represent like parts throughout, and wherein.

DETAILED DESCRIPTION OF THE PREFERRED EMBODIMENT

Figure 1:
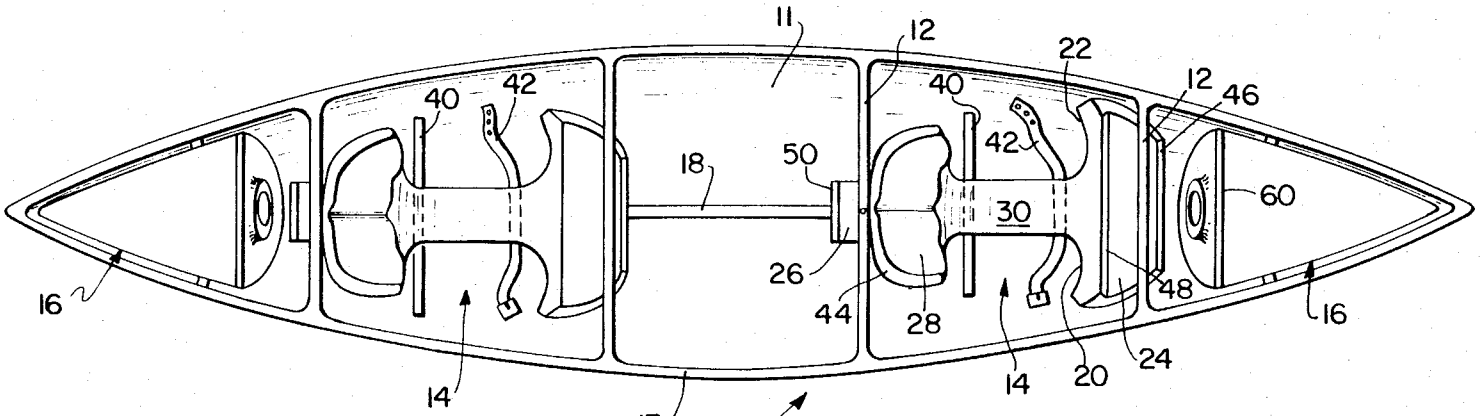
FIG. 1 is a top plan view of a canoe equipped with the structures of the present invention.

FIG. 1 shows a canoe 10 equipped with the structures of the present invention. Canoe 10 is a standard canoe such as a Coleman polyethylene or Old Towne-ABS type and includes a hull 11 which terminates in an upper edge having gunnel 13. Cross-braces 12 extend between the sides of the canoe to provide structural integrity to it.

Canoe 10 is shown equipped with two saddle storage chambers 14 and two end storage chambers 16. One saddle storage chamber 14 is connected between the two forward cross-braces 12 and the other saddle storage chamber 14 is connected between the two rear cross-braces 12. One of the end storage chambers 16 is provided in the bow of the canoe and the other end storage chamber 16 is provided in the stern of the canoe. A tube 18 extends from the bottom of one saddle storage chamber 14 to the bottom of the other saddle storage chamber 14. Chambers 14 and tube 18 provide a backbone to the canoe to increase the overall strength thereof.

It should be understood that while canoe 10 is shown with two end storage chambers 16 and two saddle storage chambers 14, each of the chambers can be used individually, if desired. Also, for a canoe of greater length, additional saddle storage chambers 14 could be added.

Figure 3:
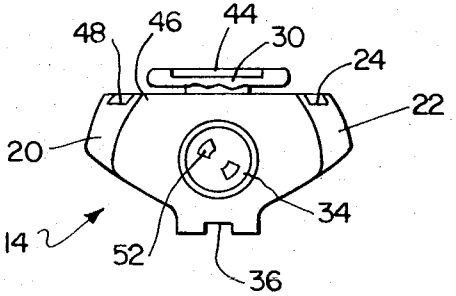
FIG. 3 is a front elevational view of the saddle storage chamber of the present invention.
Figure 2:
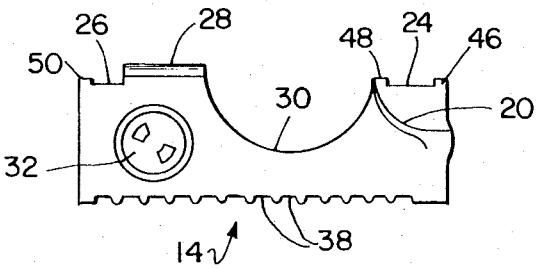
FIG. 2 is a side elevational view of the saddle storage chamber of the present invention.
Figure 4:
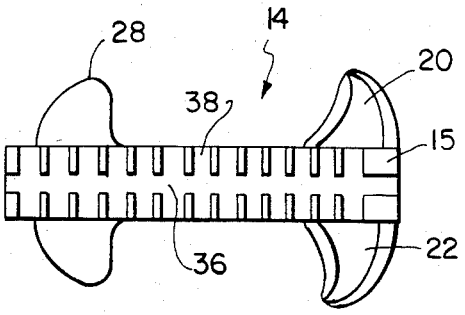
FIG. 4 is a bottom plan view of the saddle storage chamber of the present invention.

FIGS. 2–4 show details of one saddle storage chamber 14. Chamber 14 is rotationally molded to form a body which is hollow on the inside and air tight. Access to the interior of the chamber body can be gained through hatch covers 32 and 34 provided on the side and front surfaces of the chamber, respectively. When connected to the canoe, chamber 14 acts as a flotation device due to the water-tight nature thereof, while at the same time, because of hatch covers 32 and 34, supplies and other gear can be easily stored therein. In this manner, the chamber will keep the supplies dry and also allows them to be easily obtained, when needed.

Figure 7:
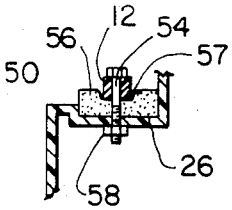
FIG. 7 is a side elevational sectional view of one mounting structure for a saddle storage chamber of the present invention.

The overall length of chamber 14 is greater than the distance between two adjacent cross-braces 12 of canoe 10. Accordingly, chamber 14 can be directly connected to the cross-braces. A first platform 24 is formed on the forward portion of chamber 14 between raised lips 46 and 48 and a similar platform 26 is formed on the rear of chamber 14 between raised lip 50 and a seat 28. As shown in FIG. 4, the bottom 15 of chamber 14 is generally rectangular in shape and can rest directly on the bottom of hull 11. When in use, chamber 14 is maneuvered such that platforms 24 and 26 are positioned below adjacent cross-braces 12 of the canoe. By way of example, FIG. 7 shows platform 26 positioned below one cross-brace 12. A foam pad 56 may be placed on platform 26 to take up any space between the platform and the cross-brace. Foam pad 56 is held in place partially by lip 50 and the rear portion of seat 28. A hole 57 is then drilled through cross-brace 12, pad 56 and platform 26 and a bolt 54 is placed through the cross-brace, pad and platform. Nut 58 is threadedly connected to bolt 54 to complete the attachment. Access to the bottom of the bolt can be obtained through hatch cover 32 on the side of the chamber. A similar connection is made between platform 46 and a second cross-brace 12. In this manner, chamber 14 is firmly affixed to the canoe. If desired, additional foam padding can be placed between the bottom 15 of chamber 14 and the bottom of canoe hull 11 to take up additional space and absorb shock.

As mentioned above, a seat 28 extends upward from one side of platform 26. Seat 28 is a standard canoe type seat designed for the canoeist to sit upright. Seat 28 is simply a wide platform contoured to one's buttocks and has no back brace. A small ridge 44 extends around the sides and rear of the seat but does not provide any support.

As is commonly known, the most effective canoeing position is kneeling within the canoe. In order to allow this position to be assumed, chamber 14 is provided with a central saddle portion 30. Saddle portion 30 is a downwardly curved area located in the central part of the body of the chamber. This central portion of the body is generally rectangular in shape and has a width of 6 to 7 inches. This width is sufficiently small to allow one to straddle the body while resting on the knees. The canoeist can press his or her knees against the main body of chamber 14 in order to brace himself or herself. However, chamber 14 also includes knee braces in the form of wings 20 and 22 which extend, respectively, to the right and left of the main portion of the chamber body. These wings are formed directly below platform 24 and are angled forwardly and downwardly of the chamber body. The wings also curve outwardly and downwardly to surround ones knees. In order to provide a proper fit, foam pads or the like may be glued to the knee engaging surfaces of the wings. By virtue of the wings 20, 22, the canoeist can brace his or her knees between the canoe hull and the wings while resting his or her derriere on the saddle portion 30. This produces a very comfortable canoeing position and also allows the canoeist to transfer his or her weight and thus control the balance of the canoe by shifting body weight in both up and down movements and also by pressing the top of his or her legs against the wings to lift the front of the canoe, as well as press his or her knees against the hull to force the front of the canoe downwardly.

In order to further improve the bracing effect provided by chamber 14, a plurality of notches 38 are formed transversely of the chamber in the chamber bottom 15, as shown in FIG. 4. These notches are spaced longitudinally along the chamber bottom to provide various adjustment positions, as will become apparent. Again with reference to FIG. 4, it will be seen that a toe block 40 can be positioned in one of the notches 38 and wedged between chamber 14 and the bottom of canoe hull 11. Block 40 can be a tube, wooden block or the like shaped to fit the contour of the hull bottom.

A strap 42, shown in FIG. 1, can be positioned in one of the forward notches 38. Strap 42 is buckled around the thigh of the canoeist when in the kneeling position. In this manner, the strap provides additional bracing support which combines with the support of wings 20 and 22 to produce a very secure position for the canoeist. Clearly, when difficult waters are encountered, in the kneeling position with ones toes pressed against block 40 and strap 42 around ones thighs and ones knees pressed against wings 20 and 22, maximum control of the canoe can be had.

The strength of canoe 10 is increased by the addition of one or more chambers 14. This is because the chamber is wedged between hull 11 and cross-braces 12. Thus, the chamber acts as a center brace to help the canoe hold its shape by pushing out on the bottom of the canoe and thus aiding in the absorption of shock or the like when the canoe is in rough water or strikes rocks, etc. This feature is very important in plastic canoes.

In order to provide additional support for the canoe, a channel 36 is formed longitudinally along the bottom 15 of the chamber, as shown in FIG. 4. A tube or stiffening bar 18, shown in FIG. 1, is placed in channel 36 and wedged between chamber 14 and the bottom of the canoe. Tube 18 is curved to fit the bottom of canoe hull 11 and is wedged against the bottom by chamber 14. In this manner, the entire bottom of the canoe is strengthened. As shown in FIG. 1, if two chambers 14 are used in the canoe, tube 18 can extend from the longitudinal channel of one chamber to the longitudinal chamber of the other chamber. This structure greatly enhances the strength of the canoe.

As can easily be seen from the above, chambers 14 provide flotation for a canoe without wasting useable storage space in the canoe since each chamber can also be used to store equipment, supplies and the like. Also, each chamber functions as an upright seat or brace for the canoeist, when necessary. The chambers may be used individually or in combination.

Figure 5:
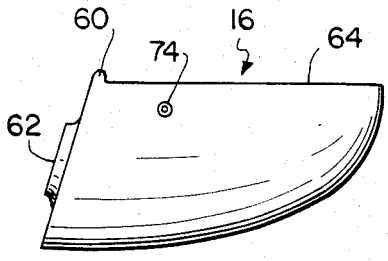
FIG. 5 is a side elevational view of the end storage chamber of the present invention.
Figure 6:
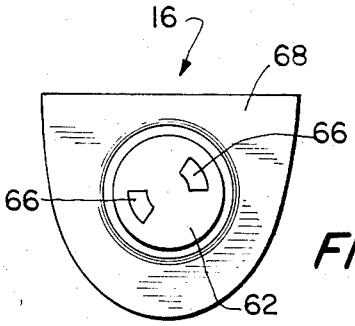
FIG. 6 is an end elevational view of the end storage chamber of the present invention.

If additional flotation for the canoe is desired, and/or if additional dry storage space is needed, end chambers 16 can be fitted to the canoe. FIGS. 1, 5 and 6 depict one end chamber 16. The end chamber is hollow and rotationally molded to form a water-tight body. The top surface 64 of the chamber is relatively flat and generally triangular in plan to fit one end of a canoe. The sides of chamber 16 downwardly converge to form a curved bottom which is similar in shape to the bottom of the canoe such that the chamber will fit relatively snugly within a canoe. The end of the chamber which is adapted to face into the canoe has an end wall 68 which contains a hatch cover 62. Hatch cover 62 allows one to gain access to the interior of the chamber for storing equipment and the like. Along the upper edge of wall 68 is a raised lip 60. Top surface 64 acts as a shelf on which equipment such as ropes or the like can be stored. Lip 60 serves to stop such items from sliding off of surface 64 over end wall 68. Clearly, the sides of the boat stop such items from sliding off the wall in other directions.

Chamber 16 includes a nut molded into the side walls on each side. One such nut is shown in FIG. 5 at 74. A similar nut is molded into the opposite side wall. To attach chamber 16 to the canoe, standardly available metal clips can be attached to chamber 16 via nut 74 and then bolted to the gunnel. Alternatively, a bolt may be passed directly through the side of the canoe and attached to nut 74. Any number of such connections can easily be envisioned and thus, no specific connection will be described in detail herein.

Figure 9:
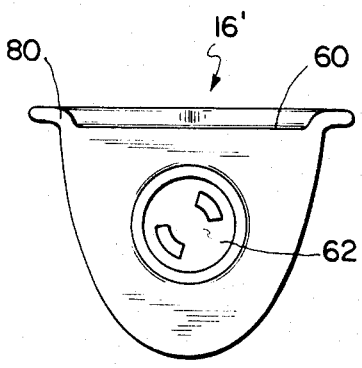
FIG. 9 is an end elevational view of a second embodiment of the end storage chamber.
Figure 10:
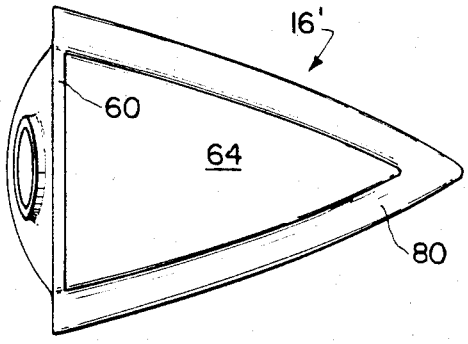
FIG. 10 is a top plan view of the end storage chamber of FIG. 9

FIGS. 9 and 10 show an end storage chamber 16' which is identical to end storage chamber 16 except for the addition of a raised outwardly protruding lip 80. Lip 80 extends along the two sides of chamber 16' which conform to the bow or stern of the canoe in which the chamber is to be used. The lip 80 protrudes above lip 60 and outwardly so that the gunnels of the canoe in which the chamber is to be used will be covered. In use, surface 60 is slightly recessed in the boat and provides an ideal storage surface. The entire top of the storage chamber completely covers the top of an end portion of the canoe and acts as an end cap. This end cap helps to protect the canoe against damage.

Figure 8:
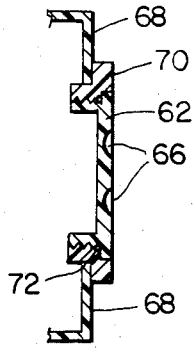
FIG. 8 is a side elevational sectional view of one hatch cover used on the present invention.

FIG. 8 shows a side elevational cross-sectional view of a hatch cover which may be used with the present invention. The hatch cover is a commonly available cover, such as is sold by B&C Products of Long Beach, Calif. The hatch cover includes an outer ring 70 which is connected directly to a wall of the chamber, such as wall 68 of chamber 16. Ring 70 can be screwed, glued or attached to the chamber body in any convenient manner. Ring 70 has a threaded opening formed therein in an outer surface containing an O-ring 72. The cover itself is shown at 62. Cover 62 has a threaded outer surface which mates with mounting ring 70 and a peripheral flange which engages O-ring 72 to form a water-tight seal. Indentations 66 are formed in the cover to facilitate its removal.

As is apparent from the above, the structures of the present invention allow needed storage space, flotation and seating to be provided in almost any standard canoe easily and efficiently. Each of the structures can be rotationally molded from commonly available synthetic resin material and easily inserted in a canoe. The structures can be conveniently removed when no longer needed or desired.

While one embodiment of the invention has been described, it will be understood that the invention is capable of still further modifications. For example, the saddle storage chamber may be attached to only one cross-brace, or the shape of the structures can be modified for use in boats other than canoes. In this latter case, the saddle storage chamber can be equipped with lateral extensions for connection to the boat gunnels, if no cross-braces are present. This application is intended to cover any variations, uses, or adaptations of the invention, following in general the principles of the invention and including such departures from the present disclosure as come within knowledge or customary practice in the art to which the invention pertains, and as may be applied to the essential features hereinbefore set forth and falling within the scope of the invention or limits of the appended claims.

What is claimed is:

1. For use in a boat having a bow, a stern, a hull extending from said bow to said stern, said hull having upwardly extending sides defining a cockpit area therebetween, said cockpit area having a floor, a device comprising:

a removable, water tight hollow body;

means mounted on said hollow body for gaining access to the interior of said hollow body;

means formed on said hollow body for attaching said body to said hull; and an area formed on said hollow body and constructed to permit a person to be supported on said hollow body, said area including a downwardly curved saddle area having sufficiently small width and height dimensions to permit a person to straddle said hollow body in a kneeling position using said cockpit floor, and a separate substantially horizontal seat area formed at a height above the height of said saddle area for permitting a person to sit erect.

2. The device as set forth in claim 1, wherein said seat portion is formed to the rear of said saddle area.

3. The device as set forth in claim 1 and further including a channel formed in the bottom of said hollow body and extending longitudinally thereof, and a bracing tube received in said channel.

4. The device as set forth in claim 3 in combination with a second similar device, and wherein said bracing tube extends from the channel in one of said devices to the channel in the other of said devices.

5. The device as set forth in claim 1 and further wherein a plurality of transverse notches are formed in the bottom of said hollow body.

6. The combination as set forth in claim 5, wherein a toe block is received in one of said notches and extends transversely of said body.

7. The device as set forth in claim 5, wherein a strap is received in one of said notches.

8. The device as set forth in claim 1, wherein said body is rotationally molded.

9. The device as set forth in claim 1, wherein said hollow body is constructed to attach to said boat between said bow and stern, and further in combination with a second hollow body, and means for attaching said second hollow body to the bow of said boat.

10. The device as set forth in claim 9, wherein said means for attaching said second hollow body to a boat comprises a nut molded into said second hollow body.

11. The combination as set forth in claim 9, wherein said second hollow body has a relatively flat top which is generally triangular in plan view, and has a raised lip along one side.

12. The combination as set forth in claim 11, wherein said second hollow body includes a raised outwardly protruding lip adapted to overlap the gunnels of a boat.

13. The device as set forth in claim 1, wherein said means for gaining access comprises a hatch cover large enough to permit supplies to be placed in said hollow body.

14. The device as set forth in claim 1, wherein said boat includes at least one cross-brace, and said attaching means comprises a first platform formed on said body for engaging said cross-brace.

15. The device as set forth in claim 14 or 1, and further including knee braces formed on said hollow body forward of said area to permit a person to brace his or her knees against.

16. The device as set forth in claim 14, wherein said boat includes at least two cross-braces and said body has a longitudinal dimension at least as great as the distance between said two cross-braces; and wherein said attaching means includes a second platform formed on said body for engaging the second of said cross-braces.

17. The device as set forth in claim 16, and further including knee braces formed on said hollow body beneath said platform.

18. The device as set forth in claim 16, wherein said second platform is formed to the rear of said area.

19. The device as set forth in claim 18, wherein said second platform is disposed to the rear of said saddle area and said seat portion.

20. For use in a boat having a bow, a stern and a hull extending from said bow to said stern, a device comprising:

a buoyant body;

means formed on said body for attaching said body to said hull;

an area formed on said body and constructed to permit a person to be supported on said body; and knee braces formed on said body forward of said area for supporting a person, wherein said attaching means is constructed to engage a member extending laterally across said boat, and wherein said knee braces are disposed at a height below the height of said attaching means.

21. A device as set forth in claim 20 wherein said buoyant body is hollow and including means for gaining access to the interior of said body.

22. For use in a boat having a bow, a stern, and a hull extending from said bow to said stern, said hull having upwardly extending sides defining a cockpit area therebetween, said cockpit area having a floor, a device comprising:

a removable, watertight, hollow buoyant body;

means mounted on said body for gaining access to the interior of said body;

means formed on said body for attaching said body to said hull; and an area formed on said body and constructed to permit a person to be supported on said body, said area including a downwardly curved saddle area having sufficiently small width and height dimensions to permit a person to straddle said hollow body in a kneeling position using said cockpit floor, and a separate substantially horizontal seat area formed at a height above the height of said saddle area for permitting a person to sit erect;

wherein said boat includes a pair of cross braces and said attaching means comprises first and second platforms formed on said body for engaging said cross braces, at least one of said platforms being considerably wider than said cross braces to enable said device to be mounted to boats having different dimensions between cross braces.

* * * * *